US006572097B2

(12) United States Patent
d'Agrella et al.

(10) Patent No.: US 6,572,097 B2
(45) Date of Patent: Jun. 3, 2003

(54) APPARATUS FOR SLOWING DOWN AND GUIDING A SIGNATURE AND METHOD FOR DOING THE SAME

(75) Inventors: Ingermar S. d'Agrella, Sussex, WI (US); Eric L. Kuhne, Big Bend, WI (US); Gary J. Laatsch, Germantown, WI (US); John M. Neary, Hartland, WI (US); Karl P. Schaefer, Brookfield, WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 10/016,625

(22) Filed: Dec. 10, 2001

(65) Prior Publication Data

US 2002/0043757 A1 Apr. 18, 2002

Related U.S. Application Data

(63) Continuation of application No. 09/223,214, filed on Dec. 30, 1998, now Pat. No. 6,394,445.

(51) Int. Cl.[7] ..... B65H 29/68

(52) U.S. Cl. ..... 271/182; 271/202; 270/50

(58) Field of Search ..... 271/182, 202, 271/187, 315, 307, 309; 270/50

(56) References Cited

U.S. PATENT DOCUMENTS

| | | | | |
|---|---|---|---|---|
| 2,177,460 A | | 10/1939 | Renz | 271/76 |
| 3,198,046 A | | 8/1965 | De Angelo | 83/24 |
| 3,459,421 A | | 8/1969 | Motter | 271/64 |
| 3,999,454 A | | 12/1976 | Tiso et al. | 83/107 |
| 4,073,223 A | | 2/1978 | Crawford | 93/93 |
| 4,093,203 A | | 6/1978 | Fischer et al. | 270/20 |
| 4,167,265 A | * | 9/1979 | Whittenberger | 270/68 |
| 4,244,565 A | | 1/1981 | Geier | 271/176 |
| 4,346,881 A | | 8/1982 | Frye | 271/208 |
| 4,373,713 A | | 2/1983 | Loebach | 271/303 |
| 4,420,154 A | | 12/1983 | Ramsey et al. | 271/304 |
| 4,506,873 A | | 3/1985 | Faltin | 270/46 |
| 4,516,759 A | * | 5/1985 | Kobler | 270/12 |
| 4,564,470 A | | 1/1986 | Schmitt | 270/21.1 |
| 4,573,671 A | | 3/1986 | Reponty | 270/20.1 |
| 4,600,186 A | | 7/1986 | Von Hein et al. | 271/182 |
| 4,638,993 A | | 1/1987 | Granzow et al. | 271/315 |
| 4,669,720 A | | 6/1987 | Rosati | 271/256 |
| 4,678,177 A | | 7/1987 | Landa | 271/238 |
| 4,682,767 A | | 7/1987 | Littleton | 270/45 |
| 4,729,282 A | | 3/1988 | Kasdorf | 83/26 |

(List continued on next page.)

FOREIGN PATENT DOCUMENTS

| | | | |
|---|---|---|---|
| EP | 0408893 | 1/1991 | 271/182 |
| EP | 0972733 | 1/2000 | |
| GB | 2042478 | 9/1980 | 271/309 |
| JP | 57145763 | 8/1982 | |
| JP | 403186560 | 8/1991 | 271/182 |

OTHER PUBLICATIONS

Man Roland, Brochure—Germany—Available at least as early as Mar., 1998.

*Primary Examiner*—Donald P. Walsh
*Assistant Examiner*—Daniel K Schlak
(74) *Attorney, Agent, or Firm*—Michael Best & Friedrich LLP

(57) ABSTRACT

A signature slow-down section in a folder of a printing press for slowing down signatures is provided. The folder is driven by a folder drive mechanism and the signature slow-down section includes a frame, a slow-down mechanism supported by the frame, and a motor connected to the slow-down mechanism for rotatably driving the slow-down mechanism separately from the folder drive mechanism. The motor is selectively operable to drive the slow-down mechanism at a speed in response to the position of the signatures relative to the slow-down mechanism.

24 Claims, 6 Drawing Sheets

U.S. PATENT DOCUMENTS 4,834,361 A 5/1989 Fenske et al. ..... 271/187
4,898,373 A 2/1990 Newsome ..... 270/58
4,919,027 A 4/1990 Littleton ..... 83/107
4,934,687 A 6/1990 Hayden et al. ..... 271/202
4,948,112 A 8/1990 Sato et al. ..... 270/60
5,014,975 A 5/1991 Hamricke ..... 271/202
5,024,569 A * 6/1991 Watts et al. ..... 414/790.3
5,039,082 A 8/1991 Littleton ..... 271/182
5,131,646 A * 7/1992 Balow ..... 271/187
5,244,201 A 9/1993 Balcerek et al. ..... 271/202
5,249,791 A 10/1993 Belanger et al. ..... 271/182
5,265,861 A 11/1993 Schaffner et al. ..... 271/182
5,265,862 A 11/1993 Jones et al. ..... 271/202
5,405,126 A * 4/1995 Mack ..... 270/6
5,417,416 A 5/1995 Marmin et al. ..... 271/270
5,520,378 A * 5/1996 Kepert et al. ..... 270/8
5,538,242 A 7/1996 Doucet ..... 271/299
5,560,599 A 10/1996 Curley et al. ..... 271/270
5,607,146 A 3/1997 Novick et al. ..... 270/42
5,641,156 A 6/1997 Nukada et al. ..... 271/176
5,647,586 A 7/1997 Novick et al. ..... 271/182
5,702,100 A 12/1997 Novick et al. ..... 271/302
5,775,222 A * 7/1998 Zweifel et al. ..... 101/227
5,794,929 A 8/1998 Curley et al. ..... 271/270
5,820,122 A 10/1998 Schneider ..... 271/188
5,851,009 A * 12/1998 Siebenmann ..... 271/270
5,904,465 A 5/1999 Villacieros Fernandez ..... 414/794.5
5,909,873 A 6/1999 Littleton ..... 271/270
5,947,470 A 9/1999 Fernandez ..... 271/272
5,950,510 A 9/1999 Scheffer et al. ..... 83/23
5,967,503 A 10/1999 Newsome ..... 270/52.04
6,019,047 A 2/2000 Klaas et al. ..... 101/483
6,019,714 A * 2/2000 Stab ..... 493/429
6,149,151 A * 11/2000 Blanchard et al. ..... 271/270
6,231,044 B1 * 5/2001 Neary et al. ..... 271/270
6,237,912 B1 * 5/2001 Motooka et al. ..... 271/273
6,270,067 B1 * 8/2001 Bergmann et al. ..... 270/13
6,302,391 B1 * 10/2001 Robert ..... 271/182
6,378,865 B1 * 4/2002 Brotherston et al. ..... 271/272
6,494,447 B2 * 12/2002 Myer, Sr. ..... 271/176

* cited by examiner

APPARATUS FOR SLOWING DOWN AND GUIDING A SIGNATURE AND METHOD FOR DOING THE SAME

This application is a continuation of and claims priority to U.S. application Ser. No. 09/223,214 filed on Dec. 30, 1998 which issued as U.S. Pat. No. 6,394,445.

FIELD OF THE INVENTION

The present invention relates, generally, to sheet processing equipment for transporting signatures moving in serial fashion along a path to one of a plurality of collation paths and, more particularly, to sheet processing equipment for collation of printed signatures to be used in the binding of a publication such as a magazine or a newspaper. The present invention relates to an apparatus for decelerating substantially evenly spaced apart successive signatures found in a stream of fast moving signatures for delivery of the signatures to a subsequent process such as a rotary fan delivery device. The present invention also relates to an apparatus for guiding successive signatures from a slow down mechanism of the foregoing kind to a downstream destination such as a rotary fan delivery device. The present invention provides an improved signature delivery system for a high speed printing press which allows for increased operating speeds with fewer jams while, at the same time, reducing or preventing damage to the signatures as the signatures travel through sheet processing equipment.

BACKGROUND OF THE INVENTION

Sheet processing equipment contemplated herein may range from apparatus associated with an office copier, to sheet or web handling devices employed in the manufacture of paperboard articles, to sheet processing equipment specifically adapted to process signatures to be used in binding or otherwise assembling books, magazines or newspapers. Each of these environments presents a somewhat different challenge in designing an efficient collator or delivery system, but the same objective applies to the entire class of apparatus, namely, accurately routing selected flexible webs or ribbon sections along a desired collation path to achieve a desired order.

In the printing industry, an image is repeatedly printed on a continuous web or substrate such as paper. The ink is dried by running the web through curing ovens. In a typical printing process, the web is subsequently slit (in the longitudinal direction which is the direction of web movement) to produce a plurality of continuous ribbons. The ribbons are aligned one on top of the other, folded longitudinally, and then cut laterally to produce a plurality of multi-paged, approximately page length web segments, termed signatures. A signature can also be one printed sheet of paper that has or has not been folded. It is often desirable to transport successive signatures in different directions along different paths in order to increase the overall operating speed and versatility of the printing process. In general, a sheet diverter operates to route fast moving signatures along a desired one of a plurality of paths as the signatures continue on to the next step in the signature processing system.

Printing press systems are operable at high speeds, typically in excess of 2,000–3,000 feet per minute (fpm). It is often desirable to run printing press equipment at the highest speeds possible in order to produce as many printed products as possible in a given amount of time. Because printing presses operate at high speeds, it is usually, if not always, necessary to reduce the speed of the signatures in the delivery system in order to shingle and to square the signatures and eventually stack the signatures. Various delivery systems for decelerating and shingling signatures are set forth in the prior art.

SUMMARY OF THE INVENTION

A system which employs a rotary fan delivery system is found after signature decelerating equipment to individually collect the signatures and subsequently pass each signature to a conveyor, such as a shingling conveyor. Generally, signatures are caused to fall or move into a receptive slot in the rotating fan-like delivery means. As the rotary fan rotates, the signatures fall out one after the other typically onto a slow moving conveyor in an overlying or shingled arrangement. Without signature decelerating equipment, in order to avoid damage to the signatures as the signatures are thrown into the respective slots of the rotary fan device, the speed of each signature must be generally slowed down by running the printing press and folder at a slower rate of speed so that the impact force of the leading edge of the signature against a dead end surface of the slot is reduced. Thus, without a slow down mechanism, reduced operating speeds limit the overall output of the printing system.

A problem which may occur when using a rotary fan delivery system concerns adequately controlling the path of each signature as the signatures are transferred from a slow down device to the rotary fan delivery system. In such systems, signatures generally fall from the slow down device to the rotary fan device. Stated differently, the signatures may be unsupported or unguided during this transfer step. Unsupported signatures have a tendency to freely flap, fold over, tear or be damaged in other different ways, or have a tendency to move to the wrong destination. The greater the distance between a slow down device and a fan delivery system, the more likely an unsupported signature will be damaged as it enters or attempts to enter the fan delivery system thereby causing jams in the overall process resulting in down time and repair expenses.

Yet another problem of utilizing a delivery system concerns guiding the signatures from a slow down mechanism to a subsequent processing device. Often, when a signature travels through a processing system between two signature transport tapes, the signature may tend to cling to one or both of the two tapes during the transition stage, instead of continuing on in a straight or substantially straight path to subsequent processing equipment. When a signature improperly follows a tape path and travels to the wrong place in the processing system, a jam can occur which results in the shut down of the entire printing production system until the jam is cleared.

Still another problem of such a delivery system concerns correctly timing the transfer of the signatures from one step in the printing process, such as a slow down step, to a subsequent step, such as a fan delivery step. If a respective signature slot in a rotary fan delivery device is not properly aligned with a signature emerging from a slow down mechanism at the appropriate time, a signature will be directed at the fan delivery device in such a way that the signature will not properly enter the rotary fan device which may cause a jam in the overall operation.

Although the problems described above generally correlate to a processing system which employs a rotary fan delivery device, the same or similar problems can occur in other delivery systems which utilize slow down mechanisms followed by other known processing equipment. The present invention may be utilized in various delivery systems for decelerating signatures and transferring the signatures to further processing equipment such as, for example, shingling devices or stackers, known to those skilled in the art.

Accordingly, there is a need for a sheet processing system that is capable of operating at high speeds, e.g., speeds in excess of 2,500–3,000 fpm and above, and yet is also capable of providing signatures that are acceptable in quality. What is needed is a delivery system which reduces the speed of signatures traveling through the processing system while allowing for an increased overall operating speed of the sheet processing system. What is also needed is a sheet processing system which increases control over signatures during a decelerating process and during transport of the signatures to a subsequent processing step.

In accordance with one embodiment of the present invention, a sheet diverter receives a fast moving stream of regularly spaced apart signatures from a sheet processing system. The sheet diverter sends the signatures down one of a plurality of collation paths. A signature slow down mechanism is positioned within the collation path such that as a signature travels down the collation path, the signature slow down mechanism grabs a tail end of the signature to slow down the speed of the signature. A pair of rotating cam lobes lying in general face-to-face relation along the collation path effectively reach into the collation path at the appropriate moment to grab the trailing end of the signature therebetween.

In a preferred embodiment, a pair of opposed tapes circulating in separate endless loops through the slow down mechanism and confining a signature therebetween, deliver the signature to the slow down mechanism which comprises a pair of counter-rotating independently driven roller or cam assemblies. The slow down mechanism has a lineal speed that is less than the lineal speed of the signatures so as to reduce the speed of the signatures as they are grabbed by the slow down mechanism.

In accordance with another embodiment of the present invention, regularly spaced apart signatures traveling at an original speed along a travel path are alternately diverted into a selected one of a plurality of collation paths to create a larger space between successive signatures in the selected paths after which the signatures are decelerated prior to being transferred to a subsequent process. The signatures are decelerated such that the leading edge of a trailing signature traveling down a selected one of the paths of signatures does not contact the trailing edge of a leading signature traveling down the same path as the leading signature is slowed down and the trailing signature continues on toward the slow down device.

In accordance with yet another embodiment of the present invention, a signature slow down mechanism is provided to decelerate the speed of individual signatures traveling along a path on their way to a further processing step in an overall sheet handling system. The slow down mechanism is positioned at the end of a collation path and is designed to be positioned as close as possible to the next device in the sheet handling system so as to increase control over the signatures as the signatures are transferred from one piece of equipment to another.

In accordance with still another embodiment of the present invention, a signature slow down assembly is provided along a path in which signatures travel on their way to further processing equipment in an overall sheet handling system. The signature slow down mechanism is capable of being opened and closed with respect to the path of the traveling signatures in order to clear away jams which may occur in the sheet handling system prior to, in or near, the signature slow down assembly. In addition, for those types of products produced in a printing press system which do not require the use of a slow down mechanism or need the advantages provided thereby, the adjustable, movable slow down mechanism can be, in effect, disengaged by moving the slow down device away from the signature path.

In a preferred embodiment, the signature slow down mechanism is capable of further adjustment so as to increase or decrease the gripping force applied to a signature as the signature is slowed down by the slow down mechanism.

In accordance with another embodiment of the present invention, a method for transporting signatures traveling at an original speed along a travel path through a sheet processing system is provided. The signatures are delivered to a slow down mechanism in which the speed of the signatures is reduced. The signatures are then fed to a further processing step. The original speed and position of the signatures, the position and operation of the slow down mechanism and the position and operation of the further processing equipment are phased in relation to each other so as to prevent or minimize damage to the signatures and increase the overall operating speed of the processing system.

In a further embodiment of the present invention, a signature guiding device is positioned intermediate of a signature slow down mechanism and a further delivery device. The guiding device is designed to prevent a signature from traveling along a wrong path as the signature is transferred from one device to the next. Preferably, the guiding device comprises a stripping signature eject idler roller which effectively strips a signature from a group of belts traveling in an endless loop in a processing system allowing the signature to properly continue on to the next step. An air blowing system may be used in combination with the eject idler roller or alternatively, by itself, to expel air in an appropriate manner thereby assisting in the control over the signatures as the signatures move from one device to another.

In accordance with another embodiment of the present invention, a signature slow-down section in a folder of a printing press for slowing down signatures is provided. The folder is driven by a folder drive mechanism and the signature slow-down section includes a frame, a slow-down mechanism supported by the frame, and a motor connected to the slow-down mechanism for rotatably driving the slow-down mechanism separately from the folder drive mechanism. The motor is selectively operable to drive the slow-down mechanism at a speed in response to the position of the signatures relative to the slow-down mechanism.

In accordance with another embodiment of the present invention, a signature slow-down section in a folder of a printing press for slowing down signatures is provided. The folder being driven by a folder drive mechanism and the signature slow-down section including a frame, a slow-down mechanism supported by the frame, a motor connected to the slow-down mechanism for rotatably driving the slow-down mechanism separately from the older drive mechanism, and a sensor operatively connected to the motor and positioned upstream of the slow-down mechanism for sensing the position of each signatures. The speed of the motor is adjusted in response to the signature position sensed by the sensor.

Accordingly, it is a general feature of the present invention to provide an apparatus for receipt of signatures from a high speed printing press and for slowing down the signatures to decrease signature damage, reduce jams and increase the overall operating speed of a sheet processing system.

Another feature of the invention is to provide a signature delivery system which is useful for a wide range of paper types and products over a wide range of press speeds and which is also useful in combination with diverter systems and signature discharge systems without significant modification to those systems.

Yet another feature of the present invention is to provide an improved signature delivery system which is easy to operate, easy to service, economical to manufacture and is relatively simple to construct and assemble.

Still another feature of the present invention is to provide a sheet processing system which increases control over signatures as the signatures travel from one processing step to another thereby decreasing signature damage, jams in the operating equipment and increasing overall speed of a printing press operation.

A further feature of the present invention is to provide a slow down mechanism that provides consistent, substantially non-varying signature transfer timing to subsequent processing equipment in a sheet handling system such as, for example, a rotary fan delivery system.

Yet, a further feature of the present invention is to effectively transfer signatures from a slow down mechanism to subsequent equipment in a sheet processing system thereby achieving the advantages provided for herein.

Other features and advantages of the invention will become apparent to those skilled in the art upon review of the following detailed description, claims and drawings.

Figure 1:
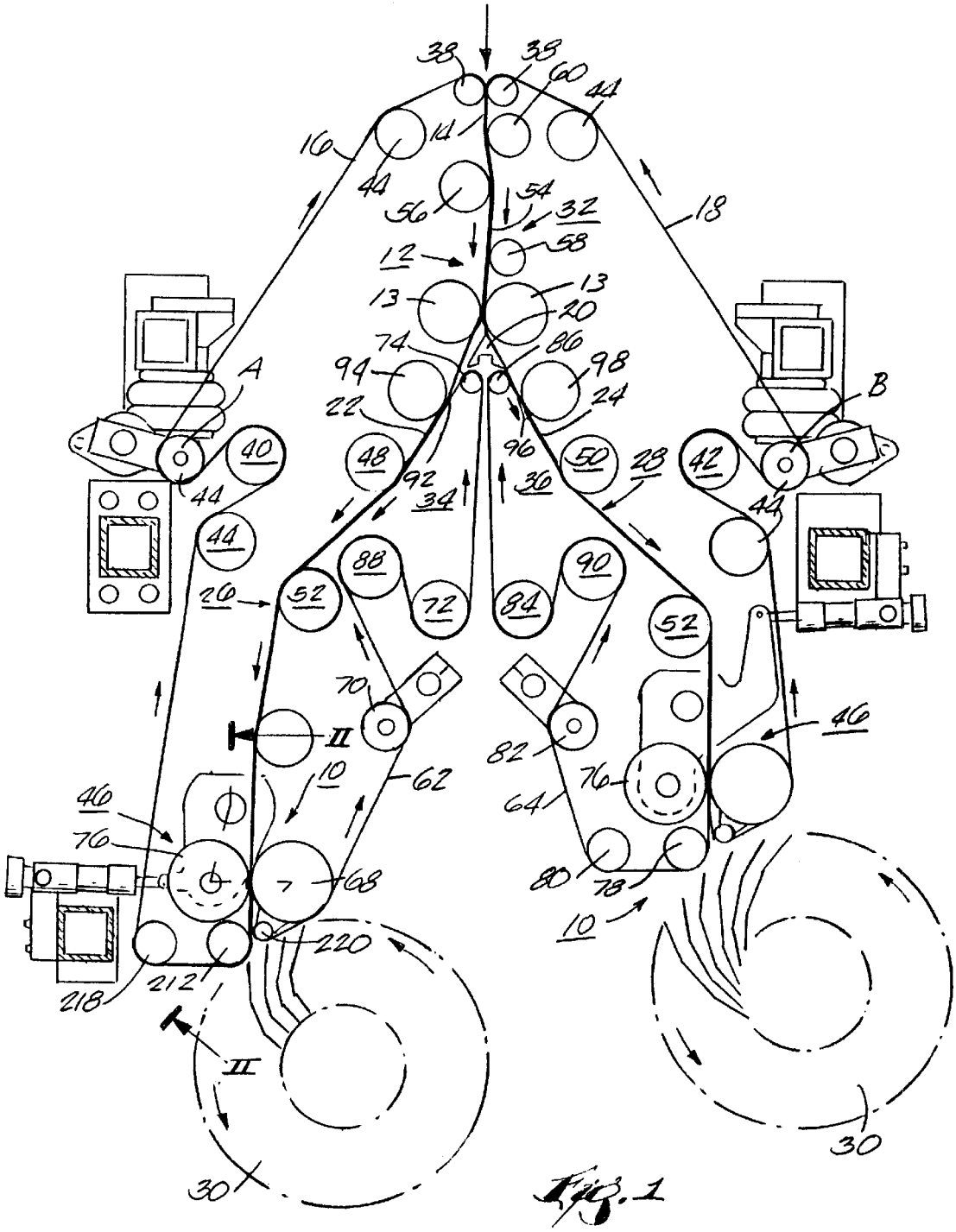
FIG. 1 is a partial schematic diagram of a pinless folder in which various features of the present invention may be employed.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter.

DETAILED DESCRIPTION OF THE PREFERRED EMBODIMENTS

Illustrated in FIG. 1 of the drawings is a partial schematic diagram of a pinless folder which is a part of a high speed printing press (not shown). A typical folder includes a forming section, a driving section, a cutting section, a diverting section and a collating section. The invention described herein is primarily directed to apparatus and methods found near the end of a collating section and upstream of further processing equipment in an overall printing press operation. A description of a typical pinless folder is found in U.S. Pat. No. 4,729,282, assigned to Quad/Tech, Inc., of Pewaukee, Wis., and is hereby incorporated by reference. Shown in FIG. 1, among other things, is a delivery system 10 according to the present invention.

Once a sheet or web has been transformed into a plurality of individual signatures as described, for example, in the '282 patent, successive signatures enter a diverter section 12 including a pair of oscillating diverter rolls 13 along a diverter path 14. The signatures are led serially via opposed tapes or belts 16 and 18 to a diverter 20. The diverter 20 alternately deflects successive signatures to a selected one of a plurality of collation paths 22 or 24. The signatures enter an appropriate collating section 26 or 28 and are fed along one of the collation paths 22 or 24 to a destination such as a rotary fan delivery device 30 and subsequently to a conveyor (not shown), such as a shingling conveyor as is known in the art. Prior to reaching the rotary fan delivery device 30, the signatures travel through the delivery system 10.

The signatures are routed along the diverter path 14 and to a selected one of the collation paths 22 or 24 under the control of a signature controller means including a primary signature controller 32 and secondary signature controllers 34 and 36. Preferably, the distance through the diverter section 12 between the primary signature controller 32 and respective secondary signature controllers 34 and 36 is less than the length of the signature to be diverted. In this way, the selected secondary signature controller 34 or 36 assumes control of the leading edge of a signature before the primary signature controller 32 releases control of the trailing edge of the same signature.

The primary 32 and secondary signature controllers 34 and 36 include one or both of opposed face-to-face belts or tapes 16 and 18 disposed over rollers in endless belt configurations. The primary signature controller 32 includes the first diverter belt 16 and the second diverter belt 18 which circulate in separate continuous loops in the directions shown by the arrows in FIG. 1 and are joined at a nip between a set of idler rollers 38 near the outfeed of a cutting section (not shown), as such is described in the '282 patent. Drive rollers 40 and 42 drive the diverter belts 16 and 18 respectively about, among other certain components in the separate continuous loops, idler rollers 38, a plurality of idler rollers 44, trailing edge signature slow down mechanisms 46 of delivery systems 10, and idler rollers 48 and 50. The diverter belts 16 and 18 are also driven around guide idler rollers 52. Both diverter belts 16 and 18 are driven by respective drive rollers 40 and 42 at the same speed, which typically is from 8% to 15% faster than the paper speed through the printing press. The faster speed of the belts 16 and 18 causes a gap to occur between successive signatures as the signatures flow serially down path 14 between the diverter belts 16 and 18. Preferably, for a signature having a length of about 10.875 inches, the gap between successive signatures is approximately between about 1–2 inches. Preferably, signatures travel generally vertically downward through the diverter section 12 alternately along collation paths 22 or 24 so that the signatures are bent as little as possible to avoid certain damage to the signatures. Since the signatures are alternately deflected and routed to one of a plurality of collation paths, the gap between successive signatures traveling down each collation path increases by at least the amount of the length of the signatures, typically, 10.875 inches. Therefore, the total gap between signatures traveling down a collation path includes the original gap length between successive signatures of about 1–2 inches, plus the length of a signature which is diverted to another collation path, plus the original gap length between what was originally successive signatures of about 1–2 inches. As will be further explained below, the gap between successive signatures in the collation paths, is one aspect of the present invention which assists in the operation of a slow down device according to that described herein.

The primary signature controller 32 includes a soft nip 54 defined by an idler roller 56 and an abaxially disposed idler roller 58. The rollers 56 and 58 cause pressure between diverter belts 16 and 18 as these belts follow the diverter path 14 through the soft nip 54. The soft nip 54 compressively captures and positively transports a signature that passes therethrough. Located upstream of the primary signature controller 32 is an idler roll 60 which also helps direct the signatures through the diverter section 12.

The secondary signature controllers 34 and 36 include a first collator belt or tape 62 and a second collator belt or tape 64, respectively, which both circulate in separate continuous loops in the directions shown by the arrows in FIG. 1. The opposed collator belts 62 and 64 respectively share common paths with the diverter belts 16 and 18 along the collation paths 22 and 24, beginning downstream of the diverter 20. In particular, collator belt 62 is transported around idler rollers 52 and 66, roll 68 of the respective trailing edge signature slow down mechanism 46, idler roller 70, drive roll 72 and idler roll 74. Collator belt 64 is transported around idler roller 52, snubber roller 76 of the respective trailing edge signature slow down mechanism 46, idler rollers 78, 80 and 82, drive roll 84, and idler roll 86. Idler rollers 88 and 90 also define the paths of the collator belts 62 and 64. Rolls 70 and 82 are belt take-up rolls and are operable to adjust the tension in each belt loop of belts 62 and 64. Rolls 72 and 84 drive belts 62 and 64, respectively, around their continuous loops. The tension of diverter belts 16 and 18 can also be adjusted with belt take-up rollers A and B, which are connected via a pivotable lever arm to an air actuator that applies adjustable pressure to the belts 16 and 18 as illustrated. Since the tension in all four belts can be adjusted, adjustable pressure between opposed belts results to positively hold and transport signatures at tape speeds. Belts 16 and 18 are driven at the same speed as belts 62 and 64 through the use of timing belts and timing pulleys (not shown), such timing belts and timing pulleys generally known to those skilled in the art. The diameter of drive rolls 40 and 42 for the diverter belts 16 and 18 and the diameter of drive rolls 72 and 84 for the collator tapes 62 and 64 can be the same diameter so that the belts 16 and 18 and tapes 62 and 64 move at the same speed as the respective drive rolls rotate at the same rpm. However, it has been discovered that over the common paths traveled by belts 16 and 18 and tapes 62 and 64, respectively, as a result of the different paths traveled by the belts and tapes, the wrap angles around the idlers in the noted paths, the tension applied to the belts and tapes, the tendency for the belts and tapes to stretch and/or creep, it has been determined that over the common paths traveled by belts 16 and 18 and tapes 62 and 64, the belts and tapes travel different distances for the same degree of rotation of the respective drive rolls. Therefore, preferably, in order to account for the difference in distance traveled by the diverter belts 16 and 18 and collator belts 62 and 64, the drive rollers 72 and 84 are made larger in diameter than drive rollers 40 and 42.

The secondary signature controller 34 includes a soft nip 92 defined by idler roller 74 operating with the abaxially disposed idler roller 94, the diverter belt 16 and the collator belt 62. Similarly, the secondary signature controller 36 includes a soft nip 96 defined by idler roller 86 operating with the abaxially disposed idler roller 98, the diverter belt 18 and the collator belt 64.

Figure 2:
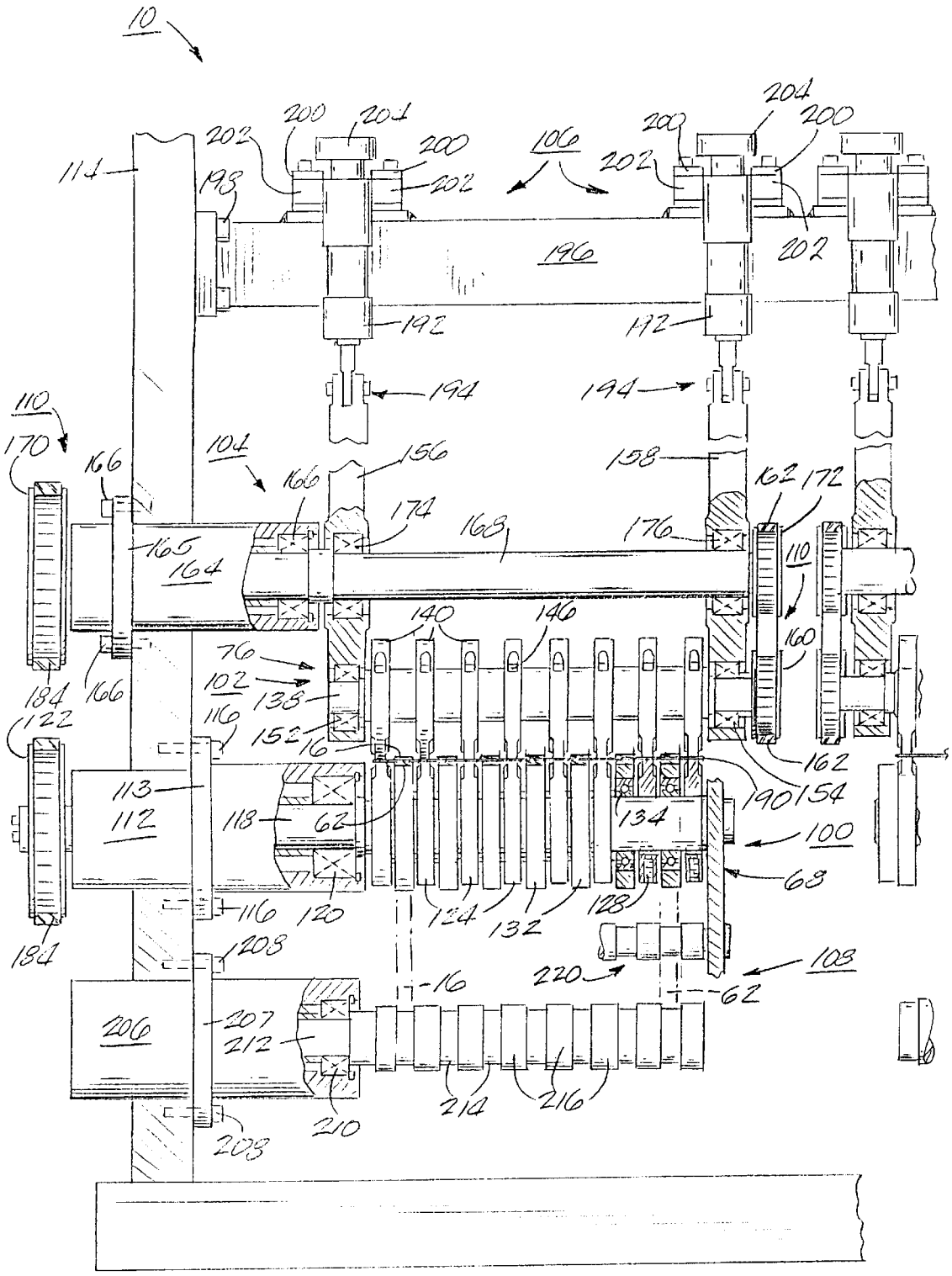
FIG. 2 is a partial cross-sectional view taken generally along line II—II of FIG. 1 showing a signature delivery system according to the present invention with certain parts added and removed for clarity.

Preferably, in a folder such as that shown in FIG. 1, it is contemplated that four signature delivery systems, two in front and two in back, will be used. FIG. 1 shows a front left-hand signature delivery system 10 and a front right-hand signature delivery system 10. Not shown are the back left-hand and back right-hand signature delivery systems which lie generally adjacent to or directly behind the respective front signature delivery systems as such are arranged in the folder. Certain elements of the front left-hand signature delivery system are shown in FIG. 2 and an adjacent back left-hand signature delivery system is shown cut away. As illustrated in FIG. 1, it is contemplated that individual signatures are fed to a rotary fan delivery device 30 such as a rotary fan. Generally, there are the same number of fan devices as there are signature slow down devices. Other processing equipment can be used in place of the rotary fan delivery system in accordance with the principles of the subject invention. Each slow down mechanism 46 of a respective delivery system 10 is driven by its own individual motor whose timing phase relationship to signature arrival can be advanced or retarded as the situation requires, the details of which will be explained below. When utilized, each rotary fan is mounted on a shaft which is also driven by individual motors whose timing can be advanced or retarded so that the rotary fan pockets can be properly positioned in time relative to each signature slow down mechanism and the fan pocket injected signature. The slow down mechanism described herein slows down the original speed of the signatures before the signatures reach further processing equipment such as the rotary fan device.

The front left-hand signature slow down mechanism 46 shown in FIG. 1 is basically the same as the front right-hand signature slow down mechanism 46 shown in FIG. 1 and works in similar fashion except that the front right-hand signature slow down mechanism is located vertically above the front left-hand signature slow down mechanism because of the difference in the location of the two rotating fan buckets 30. The two fan buckets 30 are spaced horizontally apart and at different heights because a pair of shingle conveyors (not shown) remove the product on the right-hand side of the machine and are placed one over the top of the other, as generally understood by those skilled in the art.

Figure 4:
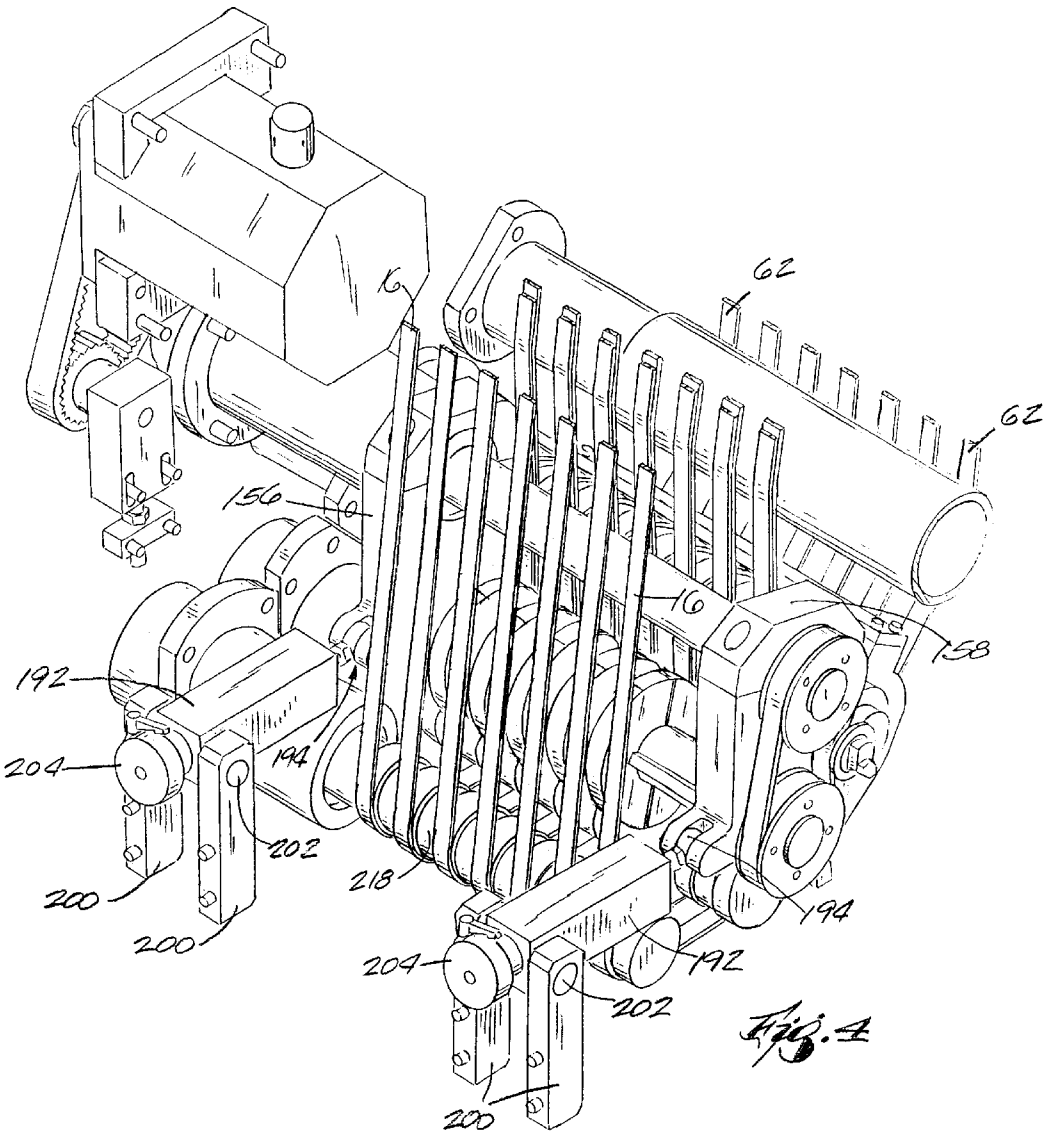
FIG. 4 is another perspective view showing even more detail of another slow down mechanism similar to that shown in FIGS. 1–3.

The other signature slow down mechanisms are, for all practical purposes, the same as the front left-hand signature slow down mechanism except for different mounting assemblies used to attach the signature delivery systems and components thereof to the proper framework in the folder. As such, only the front left-hand signature slow down mechanism will be explained in reference to most of the figures. The back left-hand signature slow down mechanism is shown in FIG. 4 to provide a different perspective in terms of the present invention.

Considering again FIG. 1, signatures traveling down the collation path 22 downstream of the diverter 20 are held between opposed belts 16 and 62 which firmly hold the signatures and positively transport the signatures on through the folder. The signatures approach idler roll 66 which generally represents the beginning of the signature delivery system 10. Belts 16 and 62 start to diverge in linear fashion as they continue through the signature delivery system 10 (see FIG. 5). In other words, downstream of idler roll 66, the belts 16 and 62 effectively let go of the signatures so that the signature slow down mechanism 46 can reduce the speed of the signatures as will be more fully explained below.

The signature delivery system 10, according to the present invention, illustratively shown in FIG. 1, and more completely shown in FIG. 2, includes one or more of the following components: a lead-in idler roller 66, a signature slow down mechanism 46 which includes a main roller assembly 100 and a snubber cam assembly 102, a pivot shaft assembly 104, an air cylinder assembly 106, a signature guide assembly 108 and a drive system 110.

With reference to FIG. 2, the main roller assembly 100 includes a housing 112 having a flange 113 which mounts to a machine side framework 114 with bolts 116. A shaft 118 extends through the housing 112 and is supported by at least one bearing 120 which is supported by the housing 112. Pulley 122 is attached to one end of the shaft 118 which enables shaft 118 to rotate by virtue of connection with the drive system 110 fully described below. Spaced apart main roller assembly cam members 124 are fixedly attached to shaft 118 with a key 126 (FIG. 5) and set screw 128. Each main roller assembly cam member 124 includes an outwardly protruding cam-shaped lobe 130 (FIG. 5), the function of which will be made clear below. Spaced between each main roller assembly cam member 124 is a respective tape or belt idler roller 132 each of which rotates on respective bearings 134 which are secured to shaft 118. A set collar (not shown) may cap the other end of shaft 118 in order to secure cam members 124 and tape rollers 132 in place. A standard nut and thread combination (not shown) could also be used to cap the other end of shaft 118 to secure the proper components in place.

Figure 5:
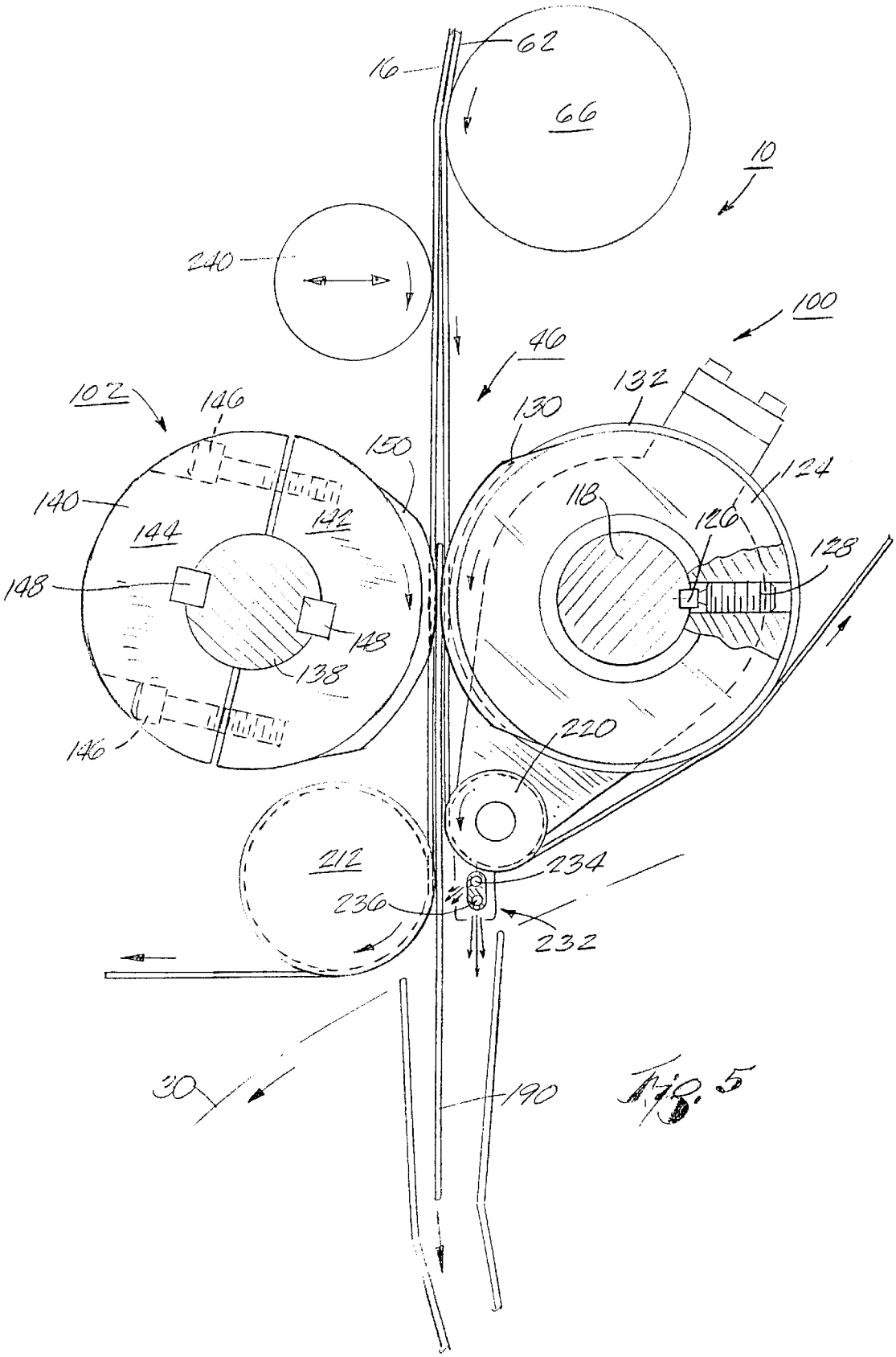
FIG. 5 is an illustrative view of a signature traveling through a signature delivery system according to the present invention and moving on to further processing equipment such as a rotary fan delivery device.

With continued reference to FIG. 2, the snubber cam assembly 102 includes a shaft 138 upon which are mounted spaced apart snubber cam assembly cam members 140 which are preferably composed of two halves 142 and 144 (FIG. 5). The two halves 142 and 144 are held together with screws 146 and fixed to shaft 138 via keys 148 (FIG. 5). Snubber cam members 140 include outwardly protruding cam-shaped lobes 150 (FIG. 5). According to the present invention, snubber cam members 140 cooperate with main roller cam members 124 to slow down signatures traveling therebetween, as will be further explained herein. The lobes 150 of snubber cam members 140 are preferably made of steel covered with a layer of hard rubber that is molded to the steel. Snubber cam members 140 are made of a split construction (FIG. 5) so that they can be easily removed or added to shaft 138 without much other assembly or disassembly required. If a snubber cam member 140 wears out due to use, it can be easily replaced with a new snubber cam member. Also, snubber cam members 140, because of their split construction, can easily be moved to different spots on the shaft 138 as desired. For example, depending on the number of desired snubber cam members 140, the snubber cam members 140 can easily be relocated to proper positions along shaft 138. Main roller assembly cam members 124 are preferably of a single construction and made from steel, but if desired, could also be of a split construction and incorporate rubber covered steel lobes, similar to snubber cam members 140. The snubber shaft 138 is supported by a pair of bearings 152 and 154 at opposite ends thereof and which are mounted in respective swing arms 156 and 158. Timing pulley 160 is attached to one end of the snubber shaft 138. Timing pulley 160 enables shaft 138 to rotate as a result of connection with a belt such as a timing belt 162 which is a part of drive system 110 more fully described below. It should be noted that because of the out-of-balance forces caused by the cam-shaped lobes 130 of the main roller assembly 100 and the cam-shaped lobes 150 of the snubber cam assembly 102, the assemblies 100 and 102 are dynamically balanced to allow for high speed rotation of the components so as to prevent damage to the assemblies 100 and 102 due to the rotational forces. Specifically, the forces generated by high speed rotation are counterbalanced in order to prevent damage to the bearings 120, 152 and 154 and reduce vibration which would occur if the assembly was left in an out-of-balance condition caused by the respective cam-shaped lobes 130 and 150.

Still referring to FIG. 2, pivot shaft assembly 104 is coupled to snubber cam assembly 102. Housing 164 having a flange 165 mounts to main machine wall 114 with screws 166 from the outside of the wall 114 as shown. The housing 164 and related parts are slipped through a bore in main machine frame 114 from the outside because assembly from the inside or other direction would be practically impossible because of the opposed components from the back side left-hand signature slow down device as shown. The housing 164 supports at least one bearing 166 which supports shaft 168. Pulley 170 attaches to one end of pivot assembly shaft 168 and timing pulley 172 attaches to the other end of pivot assembly shaft 168. Pulley 170 enables shaft 168 to rotate as a result of being connected to drive system 110, as will be described directly below. Swing arms 156 and 158 house bearings 174 and 176, respectively, which in turn support pivot assembly shaft 168. The bearings 174 and 176 allow pivot assembly shaft 168 to rotate while swing arms 156 and 158 remain stationary.

It should be noted that the bearings described above may be axially fixed in or on the relevant components in any number at ways known to those skilled in the art, such as, for example, with retaining rings or shoulders.

Now, with reference to FIG. 3 in conjunction with FIG. 2, drive system 110 will be explained. Motor 178 includes a pulley 180 mounted to a motor output shaft 182. A belt such as a timing belt 184 is properly wrapped around the pulley 180 attached to motor 178, the pivot shaft assembly pulley 170 and main roller assembly pulley 122 so as to enable pivot assembly shaft 168 and main roller assembly shaft 118 to be driven in the directions shown by the arrows in FIG. 3. Any slack in timing belt 184 may be removed with an internal belt take-up movable assembly idler 186. Timing belt 162 is also properly wrapped around pivot shaft assembly timing pulley 172 and snubber cam assembly timing pulley 160. Any slack in timing belt 162 may be removed with an external belt take-up assembly idler 188. Preferably, pivot assembly shaft 168 turns at the same rotational speed (rpm) as the snubber cam assembly shaft 138 because the two are coupled together through timing belt 162 and through identically sized timing pulleys 160 and 172. Also, preferably, pulleys 170 and 122 are identically sized so that pivot assembly shaft 168 and main roller assembly shaft 118 also turn at the same rotational speed (rpm). The drive system 110 is configured such that snubber cam assembly shaft 138 and main roller assembly shaft 118 turn in opposite directions as shown so that respective cam members 140 and 124 move in the direction of signature travel. Thus, the drive system 110 comprises a timing belt and timing pulley combination. The various pulleys may be provided with any number of teeth combinations to achieve the results described herein as can be appreciated by those skilled in the art. In a preferred embodiment, pulley 180 has 25 teeth and pulleys 170 and 122 have 40 teeth. Such an arrangement increases motor torque as applied to shafts 168, 138 and 118. In this way, more motor torque will be applied where it is needed, namely, to the shafts 138 and 118 which include respective cam lobes 150 and 130.

As shown in FIG. 4, the diverter belt 16 and collator belt 62 shown in FIG. 1 are part of separate groups of belts. Shown are seven diverter belts 16 and seven collator belts 62. The collator belts 62 operatively engage with respective tape rollers 132 of main roller assembly 100 (see FIG. 3). Since the tape rollers 132 attach to bearings 134 (FIG. 2), the belts 62 cause the tape rollers 132 to freely rotate about main roller assembly shaft 118 irrespective of the rotation of shaft 118. The main roller assembly cam members 124 keyed to shaft 118 are designed to rotate at a slower speed than tape rollers 132 as a result of shaft 118 being connected to drive system 110. The diverter belts 16 travel between snubber cam assembly cam members 140 which are provided with sufficient clearance therebetween so that the belts 16 do not detrimentally contact the sides of the respective snubber cam members 140. There are eight main roller assembly cam members 124, seven main roller assembly tape rollers 132 and eight snubber cam assembly cam members 140 shown in FIG. 2. Preferably, in order to properly support the signatures between the appropriate belts and tapes, seven belts and tapes are provided. For every belt or tape which travels around main roller assembly 100, there is provided a respective main roller assembly tape roller 132. For every tape roller 132, there is preferably provided an adjacent cam member 124. However, it is possible to use fewer snubber cam members 140 than there are main roller assembly cam members 124 (see FIG. 4 showing, for example, only five snubber cam members 140). The snubber cam members 140 can be appropriately positioned along shaft 138 between the respective tapes as previously described. It should be noted that with reference to FIG. 1, depending on the position of a slow down mechanism in a folder such as, for example, a front right-hand located signature slow down mechanism, the collator belts may travel around the snubber cam assembly and the diverter belts may travel around the main roller assembly.

FIG. 5 provides a clearer picture of a signature 190 being slowed down by a signature slow down mechanism 46. The signature which is approximately 11 inches long travels through the main roller assembly 100 and snubber cam assembly 102 unimpeded until the last three inches or so of the signature. At that point, snubber cam-shaped lobes 150 of snubber cam members 140 reach out from between the diverter belts 16 and the main roller assembly cam-shaped lobes 130 of cam members 124 reach out from between the collator belts 62 in order to effectively grab the trailing end of the signature 190 to slow the speed of the signature 190 down. Since the cam-shaped lobes 150 and 130 of respective cam members 140 and 124 move at a slower lineal speed than the signature 190 and belts 16 and 62, the speed of the signature 190, having been effectively released by diverging belts 16 and 62 prior to reaching the signature slow down device 46, is slowed as the slower rotating cam members 124 and 140 effectively grab the trailing edge of the signatures 190 with respective cam-shaped lobes 130 and 150.

Preferably, the signature slow down mechanism 46 according to the present invention, is designed in such a way that for every signature delivered from a printing press which travels past the diverter 20 and down the left-hand collation path 22, the cam-shaped lobes 130 and 150 of main roller assembly 100 and snubber cam assembly 102, respectively, turn exactly once to slow down that particular signature by the right amount. As should be clear, the lineal speed of the cam-shaped lobes 130 and 150 of assemblies 100 and 102 is designed to be slower than the speed of the signatures and the speed of the tapes 16 and 62. The signature slow down mechanism 46 is designed so that it is in synch with the printing press and timed properly to the printing press and how fast the signatures are being made at the printing press. Shafts 118, 138 and 168 turn at the proper rotational speeds so that the cam-shaped lobes 130 and 150 rotate at the proper speed by selecting the proper pulley diameters for 122, 160 and 170 and 172, and the cam-shaped lobes 130 and 150 are made of the proper outside diameter so that the cam-shaped lobes move at the proper slow down signature speed. For every two signatures that are printed at the printing press, one goes down the left-hand side of the diverter 20 and the other one goes down the right-hand side of the diverter 20 and each signature slow down mechanism slows down the respective signature that travels to it.

Taking into account a number of variables, the diameters of cam members 124 and 140 can be determined for a given slow down mechanism. For a tapes speed gain factor of 13%, a signature having a length of 10.875 inches and a signature slow down factor of 30%, the diameters of cam members 124 and 140 should be about 5.5 inches. In a preferred embodiment, the speed of the cam-lobes is designed to be 20%–40% slower than the signature speed which is generally the same as the speed of the belts confining the signature therebetween.

Figure 3:
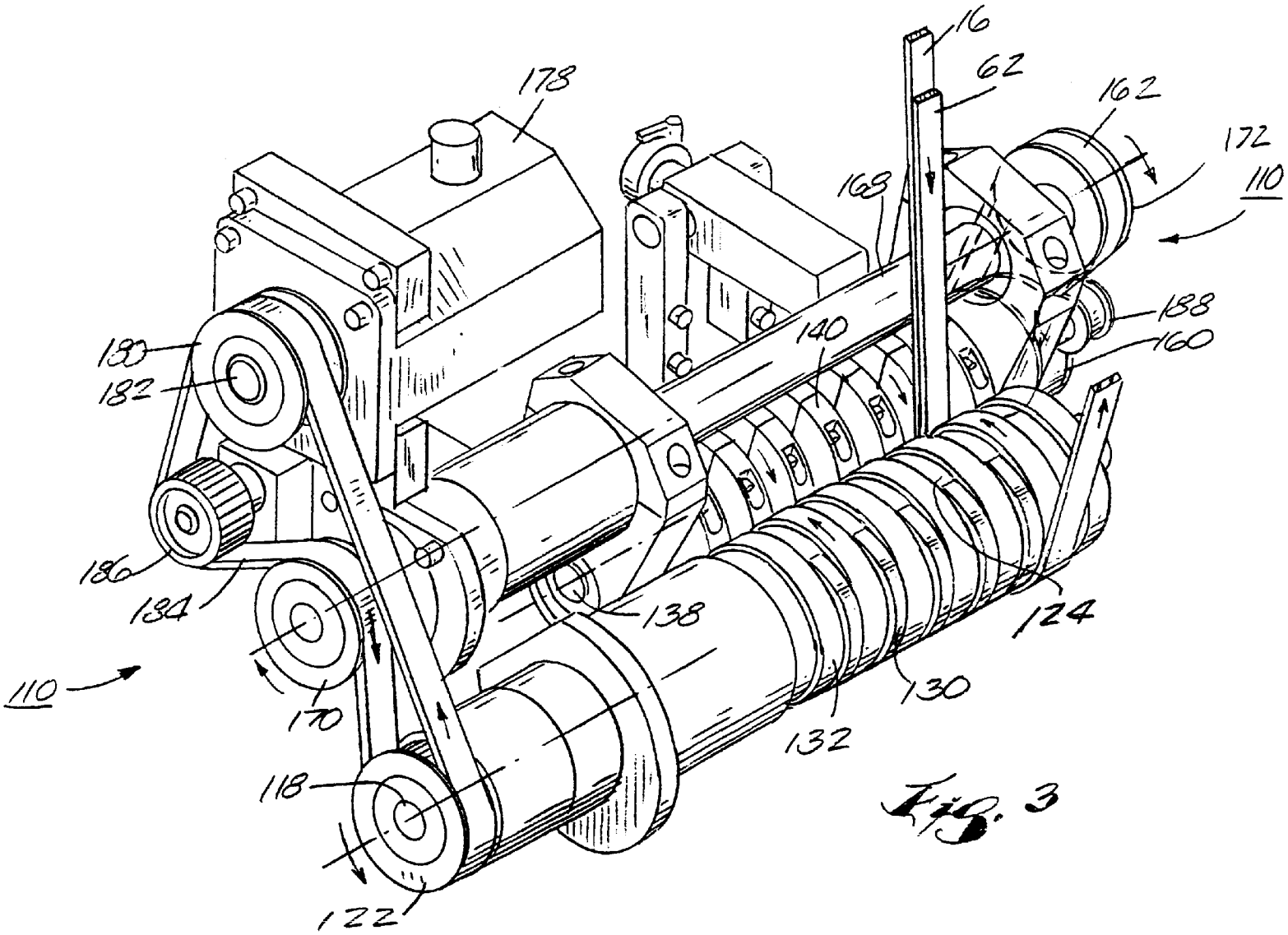
FIG. 3 is a perspective view showing in clearer detail a signature slow down mechanism of FIGS. 1–2.

It should be noted here that, with reference to FIGS. 3 and 5, initially, the cam-shaped lobes 130 and 150 can be properly aligned generally face-to-face along the signature path by removing timing belt 184 from pulleys 170 and 122. Pivot assembly shaft 168 can then be rotated until cam lobes 150 are positioned opposite cam lobes 130. After which, timing belt 184 is repositioned around pulleys 170 and 122. Once the cam lobes 130 and 150 are properly aligned, the position of the lobes 130 and 150 with respect to signature arrival can be adjusted through the use of motor 178 and the drive system 110.

Returning once again to FIG. 2 and in conjunction with the back left-hand signature slow down mechanism shown in FIG. 4, air cylinder assembly 106 is described. One end of each air cylinder 192 connects to respective swing arms 156 and 158 through a standard screw, nut and clevis combination 194. A tie bar 196 mounts to main machine wall 114 with screws 198. Although not shown, the other end of tie bar 196 attaches to another machine wall opposite wall 114. A pair of stationary brackets 200 mount to tie bar 196. The stationary brackets 200 and air cylinders 192 are provided with bores so that a separate pivot pin 202 can extend through the brackets 200 and the cylinders 192 in order to attach the other ends of the air cylinders to the stationary brackets 200. An internally threaded adjustable knob 204 is positioned on each of the respective rear threaded rod ends of the double rod end air cylinders 192.

The air cylinders 192 are provided so that the snubber cam assembly 102 can be opened or closed as needed. Engaging air cylinders 192 in one direction or the other causes swing arms 156 and 158 to rotate the snubber cam assembly 102 into or away from main roller assembly 100 (see FIG. 4). For example, in the event of a jam, at or near the signature slow down mechanism 46, the snubber cam assembly 102 can be opened via electronic controls so that the jam can be cleared away. As another example, it may be desirable to run a printing press system in which a slow down device is not needed for the particular product being processed. In such a case, the slow down mechanism can be moved away from the path of the signatures so as not to interfere with the speed of the signatures.

The air cylinders 192 are provided for another reason in addition to that noted above. The internally threaded knobs 204, which act much like a standard nut, control and limit the amount of extended (forward) stroke of the respective air cylinders 192. Since the air cylinders 192 are connected to respective swing arms 156 and 158 which are connected to snubber cam assembly 102, by turning knobs 204, a fine adjustment can be made to the gap between the two opposite facing cam-shaped lobes 130 and 150 (see FIG. 5). The adjustment of the nut-like knobs 204 can be locked with a clamping screw lever mounted on the knobs 204 (not shown) so as to lock the air cylinders in place. Adjusting the gap between cam-shaped lobes 130 and 150 ensures that signatures traveling therebetween are not squeezed too hard which could cause damage or mar the folded signatures. A certain amount of signature squeeze is necessary, however, so that the speed of the signatures is adequately and accurately slowed down as planned, keeping in mind that excessive squeezing is to be avoided to prevent damage to the signatures.

Figure 6:
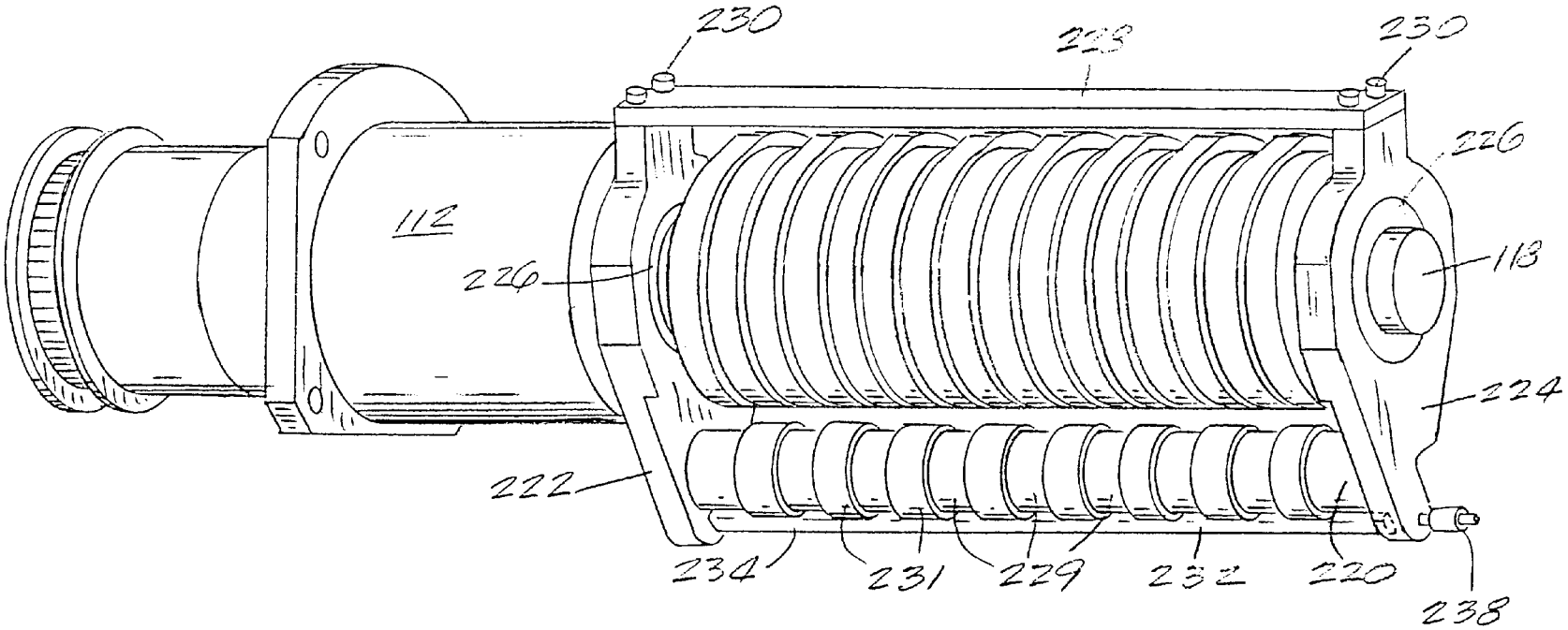
FIG. 6 is a perspective view of certain components of a signature guide assembly shown in FIG. 5.

Referring back to FIG. 2, a further aspect of the signature delivery system 10 is described. Shown is part of a signature guide assembly 108. FIGS. 5 and 6, show in further detail, other parts of a signature guide assembly 108. Shown in FIG. 2, housing 206 having a flange 207 mounts to the machine wall 114 with screws 208. Housing 206 holds at least one bearing 210 which supports an idler shaft 212. Idler 212 is shown in FIG. 1 downstream of the snubber roll 76 of slow down mechanism 46 in the path of the belts 16. Idler 212 is a grooved roll referred to as a signature eject roller. Between each groove 214 is a respective raised step 216. Belts 16 travel within respective grooves 214. The grooves 214 are wider than the width of the belts 216. Preferably, each groove 214 is slightly crowned so that as a belt 16 travels within a respective groove 214, the belt does not substantially wander from side to side between respective raised surfaces 216. The function of the crown is to keep the belts 16 running in the middle of the grooves 214 as much as possible.

As shown in FIG. 1, preferably a second idler roll 218 is provided to the left and parallel to eject roller 212 also within the path of belts 16. Idler 218 can be a grooved roll like eject roller 212 (see FIG. 4) but can also be a smooth non-grooved idler roll. Idler 218 is provided to share the belt load with idler 212, the load being generated by belt length variation, belt tension and belt wrap angle of belts 16.

Shown also in FIG. 2, is a second signature eject roller 220. The eject roller 220 is shown in FIG. 1 downstream of main roll 68 of slow down mechanism 46 in the path of the collator belts 62. Eject idler roller 220 is also a grooved roll like eject roller 212. Preferably, so that the eject rollers 212 and 220 can be positioned as close as possible to the fan delivery device 30, the diameter of eject roller 220 is smaller than the diameter of eject roller 212. As the signatures travel through the slow down mechanism 46 on their way to the fan delivery device 30, it is desirable to support the signatures as much as possible. By positioning the signature eject rollers 212 and 220 as close as possible to the outside diameter of the fan delivery device 30, there is less chance that the signatures will be damaged as they enter the fan delivery device thereby reducing the likelihood of jams occurring in this area.

FIG. 6 shows the signature eject roller 220 in the greatest detail. Brackets 222 and 224 are oppositely positioned around driven shaft 118 of main roller assembly 100. The brackets house bearings 226 so that shaft 118 is able to rotate while the brackets 222 and 224 remain stationary. The mounting brackets 222 and 224 are connected at one end by tie bar 228 which is attached to the brackets by screws 230. The brackets 222 and 224 are prevented from rotation by fixedly tieing bracket 222 to housing 112 of main roller assembly 100 with a dowel pin or similar means not shown. Mounted to the other end of brackets 222 and 224 is the signature eject roller 220 (see also FIG. 5). Eject roller 220 includes grooves 229 and raised steps 231 which are similar to grooves 214 and steps 216 of eject roller 212. Eject roller 220 can be positionally adjusted with respect to collator belts 62 depending on where the brackets 222 and 224 are fixed relative to housing 112. Although not shown, a stationary shaft is positioned through the eject roller 220. The shaft is attached to brackets 222 and 224 with screws or the like. The eject roller 220 houses a pair of bearings which allows the idler eject roller 220 to rotate on the stationary shaft. One or both of the brackets 222 and 224 contain a slot near where the stationary shaft mounts to the brackets 222 and 224. In this way, when the bearings housed in the eject roller 220 need to be replaced, the eject roller 220 can simply be removed from the brackets 222 and 224 and then easily returned thereto once the bearings have been replaced.

As the signatures travel down through a signature slow down mechanism, there is a natural tendency for the signature to want to cling to the transport belts or tapes and follow the belts or tapes rather than continue on in a straight path to further processing equipment which may lead to jams in the overall system. The signature eject rollers 212 and 220 are provided to prevent this scenario from happening. With reference to FIGS. 2, 5 and 6, the diverter belts 16 travel in the grooves 214 of eject roller 212 and the collator belts 62 travel in the grooves 229 of eject roller 220. The respective raised steps 216 and 231 are sufficiently extended to reach beyond the respective belts 16 or tapes 62. If a signature attempts to follow belts 16 and/or tapes 62 around the bottom of eject rollers 212 and/or 220, the raised step 216 and/or 231 will contact a respective side of the signature thereby forcing the signature from the respective belt or tape. In this way, the signatures are prevented from incorrectly following the belts 16 or tapes 62 and the signatures are sent on a substantially straight course into further processing equipment such as a rotary fan device 30.

The signature eject rollers 212 and 220 can be referred to as rotary signature strippers. The eject rollers rotate at the speed of the belts or tapes in contact therewith. An advantage of the rotary signature stripper is that the signature eject rollers 212 and 220 are moving as they effectively strip the signature thereby causing less damage to the signatures than what a stationary stripper may cause.

Also, shown in FIGS. 5 and 6, is an air blowing device 232 which is another component of the overall signature guide assembly 108. The air blowing device 232 and signature eject rollers 212 and 220 may be used in conjunction with or independent of each other. The air device 232 is positioned downstream of eject roller 220. The air blowing device 232 is preferably composed of two round tubes 234 and 236 but may be a single tube fixedly attached to brackets 222 and 224. One tube 234 is shown in FIG. 6. As shown in FIG. 5, the air device 232 is positioned adjacent the signature path of the signatures. The air tubes 234 and 236 preferably have a row of evenly spaced holes through which air can be blown through. The air to each tube is independently provided from a source of pressurized air, not shown, attached to one or more nipples 238. The amount of air flow and how the source of pressurized air is attached to the air device 232 is not significant in terms of the present invention. As shown in FIG. 5, the top tube 234 is positioned such that air can be blown toward the body of the signatures and towards the open side of the signatures traveling past the air device 232 from the signature slow down mechanism. The bottom tube 236 is positioned such that air can be blown generally parallel to the direction the signatures travel past the air device 232. The air device assists in guiding the signatures from the slow down mechanism 46 to the next step in the sheet processing system such as a fan delivery device 30. The air device also prevents a folded signature from opening at its open end as the signature is transferred from the slow down device to the downstream equipment. If the signature were to open, it could cause a jam of the overall system.

Another component of the overall system described thus far and which may also be a part of the signature delivery system 10 is a diverging belt or tape adjustment roller 240, shown only in FIG. 5. The roller 240 is mounted to machine wall 114 such that the roller 240 is adjustable in a horizontal direction generally transverse to the signatures and belts travel path as shown by the double arrow. The adjustable roll 240 is preferably provided to control and modify when the belts 16 and 62 will begin diverging from a point downstream of the slow down device lead-in roll 66. In addition, adjustable roll 240 can be used to manipulate the belts 16 and/or tapes 62 in order to assist in preventing a folded signature from wanting to cock or go crooked as it travels downward toward opposed cam lobes 130 and 150 of the signature slow down mechanism 46. As a folded signature travels down the collation path 22 past the lead-in idler roll 66, the signature has a tendency to want to cock or become crooked between the belt 16 and tape 62. The folded signature is not as thick on its open side as it is on the folded side. The open side of the signature tends to want to fall down quicker than the folded side as the signature travels to the slow down device 46. The ends of roller 240 can be individually adjusted generally transverse to the path of the signatures and belts. As a result, by skewing roller 240, the belt 16 and tape 62 can be caused to grip the open side of the signature more firmly thereby preventing the open side of the signature from falling ahead of the folded side of the signature. Roller 240 could also be designed to be smaller in length than, for example, lead-in roller 66, and positioned in the delivery system so as to only effect those portions of belts 16 and/or 62 which transport the open side of the signature.

As is readily apparent in FIG. 2, the main roller assembly 100, the snubber cam assembly 102, the pivot shaft assembly 104 and the signature guide assembly 108 are cantilever mounted to the framework 114 of the folder. The purpose of the cantilever design is so that all of the belts and tapes used in the delivery system 10 are easy to install, remove and replace. In other words, since a folder according to the present invention may include four delivery systems as explained above, the noted assemblies are designed in such a way that there is a break in the middle of the machine (FIG. 2) so that belts or tapes can be easily inserted, removed or replaced between the front and back delivery systems as needed.

In another embodiment of the present invention, sensors (not shown) are provided upstream of the slowdown mechanism 46 and preferably near idler lead-in roll 66 to sense the location of the leading edge of the signatures as the signatures are delivered to the slow down device 46. The sensors may be any type of sensor known to those skilled in the art designed to indicate the position of a moving article such as, for example, a through-beam sensor or an infra-red sensor. Signals from the sensors are delivered to the motor 178 to control the operation of the motor 178 which controls the drive system 110. Signals from the sensors can be provided to the motor 178 such that the cam members 124 of the main roller assembly 100 and the cam members 140 of the snubber cam assembly 102 can be properly positioned such that the respective cam lobes 130 and 150 grab the trailing end of each signature traveling through the slow down mechanism 46. If the cam-lobes 130 and 150 do not properly grab the trailing end of the signatures, the motor 178 can be advanced or retarded so as to correct the position of the cam lobes 130 and 150.

The same sensors can also be used to send signals to the motors (not shown) driving the fan delivery system 30 such that the appropriate slot in the fan delivery system is positioned to receive the signatures as the signatures are delivered to the fan delivery system.

The motors of the slow down devices and the motors of the fan delivery devices can be phased so as to provide for optimum delivery of the signatures through the slow down devices and to the fan delivery devices.

In general, with reference to FIG. 1, considering what is shown in FIG. 5, signatures travel in tandem down the diverter path 14. All of the signatures are moving at approximately the same speed and they are following each other one behind the other with a gap of a predetermined distance between them. As the signatures approach the diverter 20, one signature will go down one collation path 22 and the next signature will go down the other collation path 24 and so on. Before being diverted, the signatures have a space between them equal to about 1–2 inches. As the signatures are diverted, the space between each signature grows by the length of one signature plus another 1–2 inches because every other signature is directed down a separate collation path. Downstream of diverter 20 is a signature slow down mechanism 46. A front leading signature approaches the slow down mechanism 46. A second following signature that has not yet reached the slow down mechanism 46 is traveling still at the original speed. Since the first signature is slowed down by the slow down mechanism 46 as it travels through the slow down mechanism 46, the gap between the two signatures is shrinking at a very fast rate and there is a possibility of a collision between the signatures if the gap becomes too small. In other words, if the front signature is slowed down too much, the signature that is following it could crash into it. Because of the diverter 20, which sends every other signature to a different location, the space between the signature becomes larger by one signature length and one gap space and therefore you can slow down the front signature more than you could without the diverter 20.

The foregoing description of the present invention has been presented for purposes of illustration and description. Furthermore, the description is not intended to limit the invention in the form disclosed herein. Consequently, variations and modifications commensurate with the above teachings in skill or knowledge of the relevant art, are within the scope of the present invention. The embodiments described herein are further intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. A signature slow-down section in a folder of a printing press for slowing down signatures, the folder being driven by a folder drive mechanism, the signature slow-down section comprising:

a frame;

a slow-down mechanism supported by the frame; and a motor connected to the slow-down mechanism for rotatably driving the slow-down mechanism separately from the folder drive mechanism, the motor selectively operable to drive the slow-down mechanism at a speed in response to the position of the signatures relative to the slow-down mechanism, wherein the slow-down mechanism comprises a main roller assembly including a main shaft adapted for rotation, and a cam member fixedly attached to said main shaft, said cam member including an outwardly protruding cam shaped lobe, and a snubber cam assembly including a snubber shaft adapted for rotation and a cam member fixedly attached to said snubber shaft, said cam member including an outwardly protruding cam shaped lobe.

2. A signature slow-down section according to claim 1 wherein the signatures move in tandem along a travel path and, wherein said cam members make one revolution for each signature that travels between said main roller assembly and said snubber cam assembly so that said respective cam lobes slow down the signatures in successive order.

3. A signature slow-down section according to claim 1 wherein said motor drives said main shaft in a first direction, and said motor drives said snubber shaft in a second direction opposite the first direction, wherein said respective cam lobes of said main roller assembly and said snubber cam assembly turn in a direction corresponding to the direction of signature travel therethrough.

4. A signature slow-down section according to claim 1, further including a pair of opposed belts circulating in separate endless loops through said slow down mechanism and confining the signature therebetween, wherein said belts diverge from a point upstream of said slow down mechanism such that said belts effectively release the signature therebetween before the signature reaches said slow down mechanism.

5. A signature slow-down section according to claim 1, wherein the signatures travel generally vertically downward along a travel path through said signature slow down mechanism.

6. A signature slow-down section according to claim 1, wherein said slow down mechanism is driven at a speed slower than a speed of said folder drive mechanism thereby reducing a linear speed of the signatures by about 20 to 45 percent.

7. A signature slow-down section in a folder of a printing press for slowing down signatures, the folder being driven by a folder drive mechanism, the signature slow-down section comprising:

a frame;

a slow-down mechanism supported by the frame;

a motor connected to the slow-down mechanism for rotatably driving the slow-down mechanism separately from the folder drive mechanism; and a sensor operatively connected to the motor and positioned upstream of the slow-down mechanism for sensing the position of each signature, the speed of the motor being adjusted in response to the signature position sensed by the sensor, wherein the slow-down mechanism comprises a main roller assembly including a main shaft adapted for rotation, and a cam member fixedly attached to said main shaft, said cam member including an outwardly protruding cam shaped lobe, and a snubber cam assembly including a snubber shaft adapted for rotation and a cam member fixedly attached to said snubber shaft, said cam member including an outwardly protruding cam shaped lobe.

8. A signature slow-down section according to claim 2, wherein the signatures move in tandem along a travel path and, wherein said cam members make one revolution for each signature that travels between said main roller assembly and said snubber cam assembly so that said respective cam lobes slow down the signatures in successive order.

9. A signature slow-down section according to claim 2 wherein said motor drives said main shaft in a first direction, and said motor drives said snubber shaft in a second direction opposite the first direction, wherein said respective cam lobes of said main roller assembly and said snubber cam assembly turn in a direction corresponding to the direction of signature travel therethrough.

10. A signature slow-down section according to claim 7, further including a pair of opposed belts circulating in separate endless loops through said slow down mechanism and confining the signature therebetween, wherein said belts diverge from a point upstream of said slow down mechanism such that said belts effectively release the signature therebetween before the signature reaches said slow down mechanism.

11. A signature slow-down section according to claim 7, wherein the signatures travel generally vertically downward along a travel path through said signature slow down mechanism.

12. A signature slow-down section according to claim 7, wherein said slow down mechanism is driven at a speed slower than a speed of said folder drive mechanism thereby reducing a linear speed of the signatures by about 20 to 45 percent.

13. A slow-down section in a folder of a printing press for slowing down signatures, the folder having a bucket assembly and being driven by a folder drive apparatus, the signature slow-down section comprising:

a slow-down apparatus positioned upstream of the bucket assembly; and a motor operationally connected to the slow-down apparatus, the motor driving the slow-down apparatus separately from the folder drive apparatus, and the motor selectively operable to drive the slow-down apparatus at a speed in response to the position of a signature relative to the slow-down apparatus such that the signature is slowed before entering the bucket assembly.

14. A slow-down section according to claim 13, wherein the slow-down mechanism comprises a main roller assembly and a snubber cam assembly, the main roller assembly including a main shaft, the snubber cam assembly including a snubber shaft, and at least one of the main roller assembly and the snubber shaft including an outwardly protruding cam shaped lobe operable to cammingly engage an other of the main roller assembly and the snubber shaft.

15. A slow-down section according to claim 14, wherein the slow-down mechanism includes a pivot shaft assembly, a first timing belt engaging the snubber cam assembly and the pivot shaft assembly, and a second timing belt engaging the main roller assembly and the pivot shaft assembly, and wherein the motor includes an output pulley mounted to an output shaft of the motor such that the second timing belt engages the motor output pulley, the motor causing the second timing belt to drive the pivot shaft assembly and the main roller assembly, the pivot shaft assembly causing the snubber cam assembly to rotate by virtue of the first timing belt.

16. A slow-down section according to claim 15, wherein the second timing belt is arranged to rotate the pivot shaft assembly and the main roller assembly in opposite directions so that the main shaft and the snubber shaft rotate in opposite directions.

17. A signature slow-down section in a folder of a printing press for slowing down signatures, the folder having a bucket assembly and being driven by a folder drive apparatus, the signature slow-down section comprising:

a slow-down apparatus positioned upstream of the bucket assembly;

a motor operatively connected to the slow-down apparatus for driving the slow-down apparatus separately from the folder drive apparatus; and a sensor operatively connected to the motor and positioned upstream of the slow-down apparatus, the sensor sensing the position of each signature, the speed of the motor being adjusted in response to the signature position sensed by the sensor.

18. A signature slow-down section according to claim 17, wherein the slow-down apparatus further includes a snubber cam assembly including a snubber shaft adapted for rotation and a cam member fixedly attached to the snubber shaft, the cam member including an outwardly protruding cam shaped lobe.

19. A signature slow-down section according to claim 17, wherein the slow-down apparatus comprises a main roller assembly including a main shaft adapted for rotation, and a cam member fixedly attached to the main shaft, the cam member including an outwardly protruding cam shaped lobe.

20. A signature slow-down section in a folder of a printing press for slowing down signatures, the folder having a bucket assembly and being driven by a folder drive apparatus, the signature slow-down section comprising:

a frame;

a slow-down apparatus supported by the frame, the slow-down apparatus including a main roller assembly and a snubber cam assembly, the main roller assembly including a main roller, the snubber cam assembly including a snubber shaft, at least one of the main roller assembly and the snubber shaft including an outwardly protruding cam shaped lobe operable to cammingly engage an other of the main roller assembly and the snubber shaft; and a motor connected to the slow-down apparatus for rotatably driving the slow-down apparatus separately from the folder drive apparatus, the motor operable to drive the slow-down apparatus at a speed in response to the position of the signatures relative to the slow-down apparatus, the motor driving the main shaft in a first direction, the motor driving the snubber shaft in a second direction opposite the first direction.

21. A signature slow-down section according to claim 20, wherein the cam shaped lobe turns in a direction corresponding to the direction of signature travel through the signature slow-down section.

22. A signature slow-down section in a folder of a printing press for slowing down signatures, the folder being driven by a folder drive apparatus, the signature slow-down section comprising:

a frame;

a slow-down apparatus supported by the frame, the slow-down apparatus including a main roller assembly and a snubber cam assembly, the main roller assembly having a main roller rotatably connected to the frame, the snubber cam assembly having a snubber shaft rotatably connected to the frame and being selectively cammingly engagable with the main shaft;

a motor connected to the slow-down apparatus for rotatably driving at least one of the main roller assembly and the snubber cam asembly separately from the folder drive apparatus; and a sensor operatively connected to the motor and positioned upstream of the slow-down apparatus for sensing the position of each signature, the speed of the motor being adjusted in response to the signature position sensed by the sensor.

23. A signature slow-down section according to claim 22, wherein the cam shaped lobe turns in a direction corresponding to the direction of signature travel through the signature slow-down section.

24. A signature slow-down section according to claim 22, wherein the motor drives the main shaft in a first direction, and wherein the motor drives the snubber shaft in a second direction opposite the first direction.

* * * * *